United States Patent [19]

Ramaker

[11] Patent Number: 5,027,586

[45] Date of Patent: Jul. 2, 1991

[54] SIDE LOADING MACHINE

[75] Inventor: Dennis Ramaker, Valders, Wis.

[73] Assignee: Nigrelli Systems, Inc., Kiel, Wis.

[21] Appl. No.: 470,231

[22] Filed: Jan. 25, 1990

[51] Int. Cl.[5] ..... B65B 5/06; B65B 43/28

[52] U.S. Cl. ..... 53/458; 53/468; 53/566; 493/316

[58] Field of Search ..... 53/458, 566, 564, 468; 493/316, 319, 318

[56] References Cited

U.S. PATENT DOCUMENTS

| | | | |
|---|---|---|---|
| 3,956,868 | 5/1976 | Ganz et al. | 53/566 X |
| 4,066,009 | 1/1978 | Calvert et al. | 493/316 |
| 4,109,444 | 8/1978 | Lee | 493/316 X |
| 4,232,591 | 11/1980 | Karpinsky | 493/316 X |
| 4,633,655 | 1/1987 | Nigrelli, Sr. | 53/566 X |
| 4,685,275 | 8/1987 | Nigrelli, Sr. | 53/566 X |
| 4,709,538 | 12/1987 | Olsen, Jr. et al. | 53/566 |

*Primary Examiner*—James F. Coan

*Attorney, Agent, or Firm*—Fuller, Ryan & Hohenfeldt

[57] ABSTRACT

A side loading machine is capable of very rapid loading of complements of articles into open side cartons. Carton blanks are unfolded at an unfolding station and advanced to a loading station along a carton path. At the loading station, pusher bars are indexed in closed paths located perpendicular to and on both sides of the carton path. The pusher bars are indexed to push the complements from article waiting stations into the carton. New articles are fed to the article waiting stations between consecutive pusher bars. A split platform cooperates with a pusher bar to guide the articles into each article waiting station. Oscillating fingers and paddles positively control the locations of the carton flaps prior and subsequent to loading the complements into the cartons.

42 Claims, 5 Drawing Sheets

SIDE LOADING MACHINE

BACKGROUND OF THE INVENTION

1. Field of the Invention

This invention pertains to article handling, and more particularly to apparatus for loading complements of articles into carrying cases.

2. Description of the Prior Art

Various equipment has been developed to load cans, bottles, and other articles into boxes and other types of containers. Machinery for filling open top and open side cartons with cans or bottles is in widespread use.

An exemplary machine for side loading open side cartons is disclosed in U.S. Pat. No. 4,633,655. The case packer of the U.S. Pat. No. 4,633,655 simultaneously loads both sides of an open side carton with complements of the desired number of articles. Opposed rams reciprocate in unison to push the articles from a waiting station into the carton.

It has been considered desirable to increase the loading speed of side loading machines. Thus, although the case packer of the U.S. Pat. No. 4,633,655 has enjoyed commercial success, it nevertheless is subject to improvement.

SUMMARY OF THE INVENTION

In accordance with the present invention, a side loading machine is provided that reliably loads complements of articles into open side cartons at higher speeds than was previously possible. This is accomplished by apparatus that includes chain driven pusher bars that index in closed paths to push the complements into the opposite sides of a waiting carton.

The articles to be loaded are fed intermittently in a horizontal downstream direction along two article paths by respective spaced apart and parallel infeed conveyors. The infeed conveyors feed the articles to respective article waiting stations at the downstream ends of the article paths.

The cartons are advanced downstream in a path located parallel to and between the two article infeed conveyors. Carton advancement is achieved by an intermittently operated mechanism that includes flight bars upstandingly connected to endless chains. The cartons are captured in pockets between consecutive flight bars.

The cartons are supplied to the side loading machine in the form of folded blanks. The present invention includes a carton unfolding station at which the blanks are unfolded by a novel cam and suction cup arrangement. The blanks are stacked above the upstream end of the carton advancement mechanism so as to have leading and trailing edges. During a brief dwell period at which the carton advancement mechanism is stationary, one or more suction cups swing in an arc to pull the lowermost blank downwardly into a selected pocket of the carton advancement mechanism. The upstream flight bar of the selected pocket is tilted at an angle in the upstream direction relative to the carton path. As the blank is pulled toward the pocket, the blank trailing edge encounters an unfolding cam. The unfolding cam is designed to cooperate with the suction cups to partially unfold the blank into a parallelogram shape by the time the blank enters the pocket. When the blank has been pulled completely into the pocket, the blank trailing edge enters a notch in the unfolding cam. Simultaneously, the blank leading edge abuts the downstream flight bar of the pocket. Accordingly, the partially unfolded blank is captured in the pocket at its leading and trailing edges.

At the conclusion of the dwell period, the carton advancement mechanism operates to advance the flight bars in the downstream direction. Such advancement causes the pocket upstream flight bar to straighten to a vertical attitude relative to the carton path. As the pocket upstream flight bar straightens, it strikes the trailing edge of the partially unfolded blank and pushes the blank into a completely unfolded open side carton. The carton advancement mechanism then intermittently advances the carton in the downstream direction to a loading station.

At the loading station of the side loading machine, complements of the desired number of articles are loaded simultaneously into both open sides of the carton. For that purpose, the present invention comprises a side loading mechanism having endless chains on both sides of the carton path and generally aligned with the two article paths. The chains travel in paths that are perpendicular to the carton and article paths. Pusher bars extend from the chains so as to be parallel to the carton and article paths. The chains index in timed relation to the advancement of the cartons and articles to simultaneously push the articles at both article waiting stations into the opposite sides of a waiting carton.

To guide the articles into the waiting stations, the side loading machine of the present invention includes a split platform located on each side of the carton path and between the carton path and the corresponding article waiting station. Each split platform has two flat plates. One of the flat plates is stationary, and it lies in the same plane as the article infeed conveyor. The stationary plates are adjacent the carton path. The second plate of each split platform is movable, and it is adjacent the associated article waiting station. The movable plate is operable to rise and fall between a first position whereat it is coplanar with the stationary plate and a second position whereat it lies in a plane higher than the stationary plate. The movable plate has a guide edge that is generally coplanar with the edge of the article path adjacent the carton path.

To further guide the articles into the article waiting station, the pusher bars of the side loading mechanism are spaced apart along the endless chains at carefully controlled distances. As each infeed conveyor feeds articles in the downstream direction to the corresponding article waiting station, the side loading mechanism is idle, and a pusher bar is located at a ready position generally coplanar with the edge of the article path remote from the carton path. Simultaneously, the split platform is operated to raise the movable platform thereof to a location approximately coplanar with the pusher bar at the ready position. In that manner, the pusher bar at the ready position and the movable plate cooperate to positively guide the articles as they enter the article waiting station.

When full complements of articles have entered the article waiting stations, the split platforms are operated to lower the movable plates to the plane of the stationary plates. Then the side loading mechanism is operated to index the pusher bars from their respective ready positions toward the carton path. Indexing of the side loading mechanism is timed to match a dwell period of the carton advancement system. Consequently, the pusher bars at the ready positions push the articles from the respective article waiting stations into the open sides of the waiting carton. The side loading mechanism is indexed a distance such that the pusher bars previously at the ready positions index to respective stop positions adjacent the carton open sides. Indexing the side loading mechanism also places new pusher bars at the respective ready positions. The carton advancement mechanism then operates to advance the filled carton downstream and to present a new carton at the loading station. The pusher bars at the stopped positions act to hold the articles in the carton as the filled carton moves downstream away from the loading station. Simultaneously with the advancement of the filled carton downstream, the movable plates of the split platforms are raised and the infeed conveyors advance complements of articles downstream to the article waiting stations, and the cycle is repeated.

To control the flaps of the cartons as they approach the loading station, the present invention includes a series of generally conventional plows that control the carton top and bottom flaps. In addition, flap tuckers are provided that control the leading and trailing flaps of each open side carton. Each flap tucker comprises a curved finger that oscillates about a vertical axis in timed relation to the downstream advancement of the cartons. The fingers rotate to strike and bend the carton leading flaps forwardly, i.e., in a downstream direction relative to the carton, such that the leading flap flaps are parallel to the downstream direction. The leading flaps are retained in the downstream orientation by the fingers as the carton is advanced until the leading flaps are adjacent the side loading mechanism pusher bars at the stopped positions thereof adjacent the carton path. The pusher bars at the stopped positions then take over to maintain the leading flaps at their correct orientation. Complete advancement of the carton to the loading station causes the leading flaps to pass by the downstream ends of the respective pusher bars at the stopped positions, but the flaps are nevertheless out of the way of the incoming articles. The tucker fingers also operate to control the carton trailing flaps to be out of the way of the article at the loading station.

As the filled cartons move downstream from the loading station, oscillating paddles on both sides of the carton path operate to close the carton leading and trailing flaps. Paddle oscillation occurs during the dwell periods of the carton advancement mechanism. The paddles are also designed to prevent articles loaded within the carton from falling out of the carton ends until all the carton flaps are closed.

Further in accordance with the present invention, the side loading machine can load complements of articles into open side trays. Trays are supplied to the machine in the form of planar blanks. During a dwell period of the carton advancement mechanism, suction cups pull the lowermost blank from a stack thereof in an arc and into a pocket between two consecutive flight bars of the carton advancement mechanism. The suction cups attach to a bottom panel of the blank. During the arcuate movement of the planar blank, the trailing edge thereof strikes an unfolding cam. The cam causes a blank trailing panel to fold relative to the bottom panel. Simultaneously, a leading panel of the blank strikes the downstream flight bar of the pocket. Continued downward pulling on the blank bottom panel by the suction cups causes the leading panel to fold relative to the bottom panel. As a result, the blank is unfolded to an open side and open top tray, and it is captured between two consecutive flight bars. At the end of the dwell period, the carton advancement mechanism advances the tray toward the loading station. The various components for loading the trays and for controlling their flaps are the same as those used for the open side cartons.

Other objects and advantages of the invention will become apparent to those skilled in the art upon reading the disclosure.

DETAILED DESCRIPTION OF THE INVENTION

Figure 2:
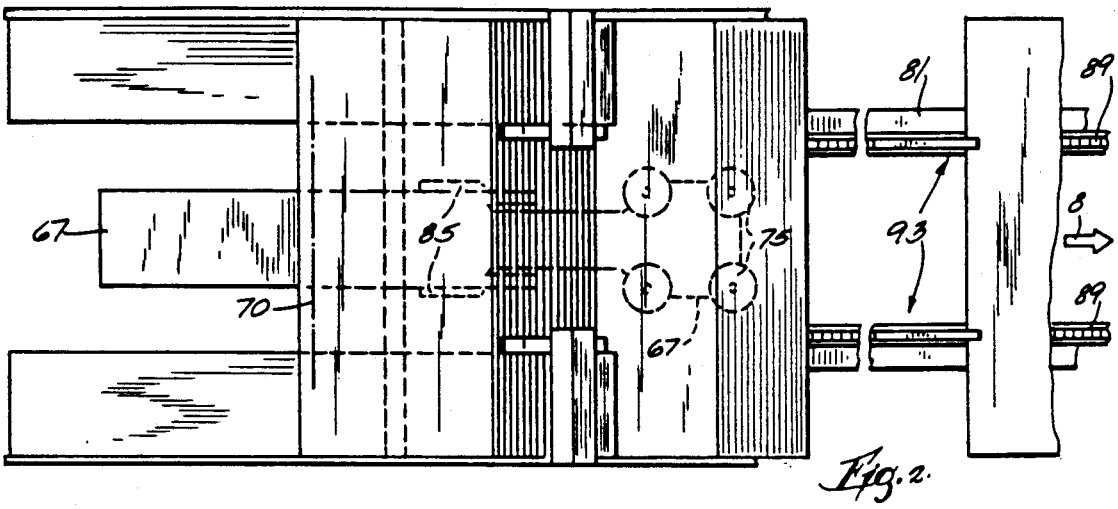
FIG. 2 is a top view of FIG. 1.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

General

Referring especially to FIGS. 1–6, 9, and 10, reference numeral 1 indicates the high speed loading machine of the present invention. The side loading machine 1 comprises an unfolding station 3 at which folded carton blanks 5 are unfolded into fully unfolded open side cartons 7. The cartons 7 are advanced intermittently along a carton path 8 in a horizontal downstream direction 9 by a carton advancement mechanism 11 to a loading station 13. During dwell periods of the carton advancement mechanism 11, the blanks 5 are pulled from a supply hopper 35 and to the carton advancement mechanism for unfolding. Prior to reaching the loading station 13, the carton leading and trailing flaps 49 and 51, respectively, are positively controlled, as by flap tuckers 19. Articles 17 to be loaded into the cartons reach the loading stations by means of parallel infeed conveyors 20. The infeed conveyors 20 straddle the carton path 8 to form article paths 21.

At the loading station 13, complements 15 of a desired number of articles 17 are loaded into the cartons 7 from both sides thereof by a side loading mechanism 18. Loading occurs during dwell periods of the carton advancement mechanism 11.

After the cartons have been filled, the carton advancement mechanism 11 advances the filled cartons 23 further downstream to a flap closing station 25. When all the flaps 45, 47, 49, and 51 of the filled cartons 23 are fully closed and glued, the filled cartons are ready for shipment.

Open Side Carton

Figure 9:
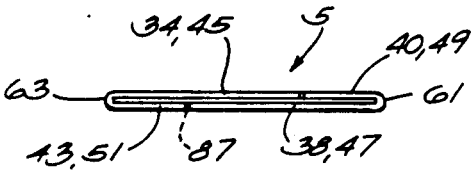
FIG. 9 is a side view of a folded carton blank.
Figure 10:
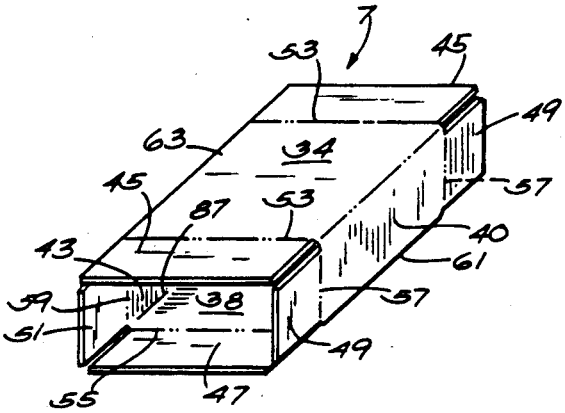
FIG. 10 is a perspective view of an open side carton shown in a fully unfolded configuration.

The carton blank 5 and fully unfolded carton 7 are shown in detail in FIGS. 9 and 10, respectively. The carton 7 has a top panel 34, a bottom panel 38, a leading panel 40, and a trailing panel 43. Extending oppositely from the top panel 34 are top flaps 45. Bottom flaps 47 extend from the bottom panel 38; leading flaps 49 extend from the leading panel 40; and trailing flaps 51 extend from the trailing panel 43. Fold lines 53 separate the top flaps 45 from the top panel; fold lines 55 separate the bottom flaps 47 from the bottom panel 38; fold lines 57 separate the leading flaps 49 from the leading panel; and fold lines 59 separate the trailing flaps 51 from the trailing panel 43.

The cartons 7 are supplied to the side loading machine 1 as folded blanks 5. The blanks are folded such that the top panel 34 and associated flaps 45 and the leading panel 40 and associated flaps 49 are superimposed on the bottom panel 38 and its flaps 47 and on the top panel 43 and its flaps 51. The fold line 61 between the leading panel and the bottom panel is the leading edge of the blank. The fold line 63 between the top panel and the trailing panel is the trailing edge of the blank.

Main Drive

Figure 7:
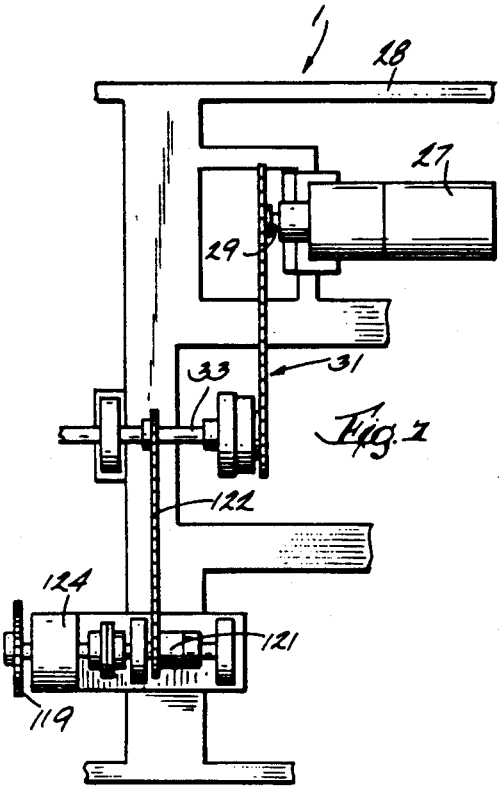
FIG. 7 is a simplified top view of the side loading machine frame showing a portion of the mechanism for driving various components of the machine.
Figure 8:
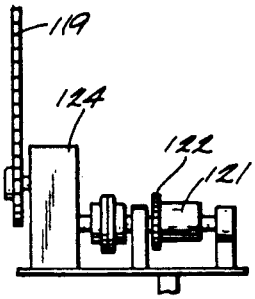
FIG. 8 is a side view of FIG. 7.

Looking briefly at FIGS. 7 and 8, power for driving the side loading machine 1 is supplied by an electric motor 27 mounted to the machine frame 28. The output shaft 29 of the motor 27 is connected by a sprocket and chain arrangement 31 to a main drive shaft 33. The main drive shaft 33 drives various power takeoffs, such as are known in the art. In turn, the power takeoffs drive the various mechanisms of the side loading machine.

Unfolding Station

Referring back to FIGS. 1 and 2, the unfolding station 3 is located at the upstream end of the carton advancement mechanism 11. Folded blanks 5 are stored in the hopper 35, which is fixed to the machine frame 28 by upstanding legs 36. The planes of the blanks preferably make an angle with the horizontal carton path 8. The blanks are partially supported by the hopper back wall 37 and partially by short pins 39 extending from the hopper side walls 41. The blank trailing edges 63 are against the hopper back wall 37.

During a dwell period of the carton advancement mechanism 11, a blank 5 is pulled from the hopper 35 and partially unfolded into a parallelogram shape 7*a*. The unfolding operation is performed by a vacuum system 65 acting in conjunction with one or more unfolding cams 85 and the carton advancement mechanism 11. In the illustrated construction, the vacuum system 65 comprises a long lever 67 that is mounted to the machine frame 28 for rotation about a pivot 69; the pivot 69 defines a horizontal axis 70. To one end of the lever 67 is mounted one or more suction cups 75. Each suction cup is connected by a line 77 to a source of vacuum, not shown.

The second end of the lever 67 is connected to a bell crank 71 that may be driven through a chain and sprocket arrangement 72 from a power takeoff 73. The power takeoff 73 in turn is driven at a constant rate by the machine main drive shaft 33, FIG. 7. The power takeoff 73 and chain and sprocket arrangement 72 drive the bell crank 71 to oscillate the lever 67 about the pivot 69 between two end positions. The first end position is shown in phantom lines in FIG. 1, whereat the suction cups are shown at reference numerals 75' and the lever is shown at reference numeral 67'. At the first end position, the suction cups 75' engage the bottom panel 38 of the lowermost blank 5*a* in the hopper 35. Upon subsequent rotation of the lever from the position 67' in the direction of arrow 79, the suction cups pull the lowermost blank 5*a* from the hopper toward the second end position.

Figure 1:
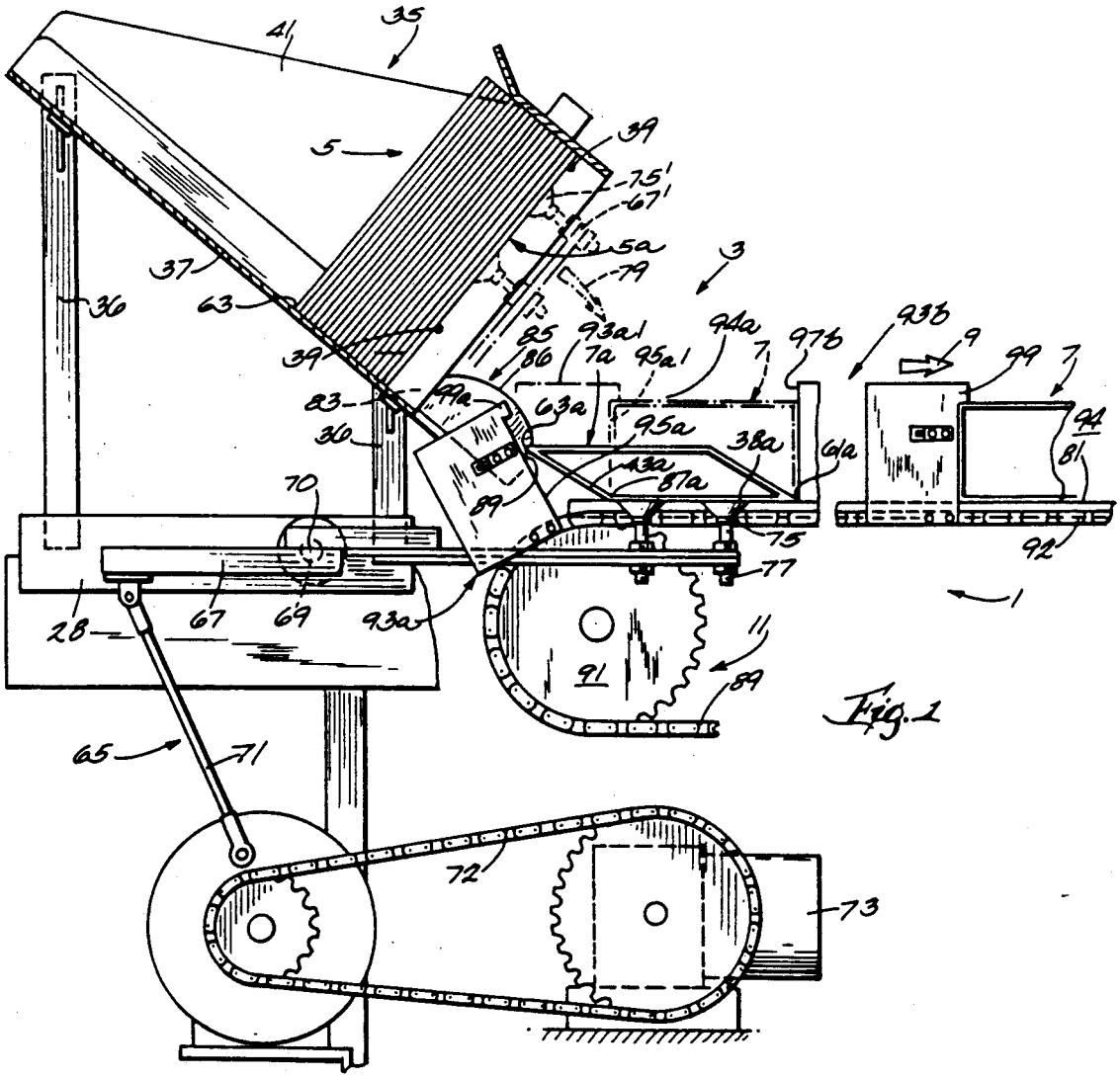
FIG. 1 is a side view of the carton unfolding station of the present invention.

The second position of the suction cups and the lever are shown in solid lines 75 and 67, respectively, in FIG. 1. In the second end position, the blank bottom panel 38*a* is horizontal and is drawn against a pair of spaced horizontal support strips 81. The support strips 81 are fixed to the machine frame 28 and extend in the downstream direction 9 from the unloading station 3.

As the blank 5*a* is pulled by the suction cups 75 from the hopper 35 to the support strips 81, the blank trailing panel 43*a* near the blank trailing edge 63*a* strikes the back edges 83 of the unfolding cams 85. Continued rotation in the direction of arrow 79 of the lever 67 causes the blank trailing edge 63*a* to ride along the profiles 86 of the cams 85. The cam profiles 86 are designed such that the blank trailing panel 43*a* is bent along the fold line 87*a* between the bottom panel 38*a* and the trailing panel 43*a*. Simultaneously, the blank is bent about the other fold lines between the corresponding pairs of adjacent panels. The cam profiles 86 are further designed such that the blank bends only along the fold lines between the adjacent panels and not at locations within the interiors of the various panels themselves.

As the vacuum system 65 pulls the blank 5*a* toward the second position of the solid lines of FIG. 1, the blank trailing edge 63*a* enters a notch 89 in each cam profile 86. At that point, the blank bottom panel 38*a* is against the machine support strips 81.

Carton Advancement Mechanism

The carton advancement mechanism 11 performs two functions. One function, as mentioned previously, is to intermittently advance unfolded cartons 7 in the downstream direction along the carton path 8 from the unfolding station 3 to the loading station 13. The carton advancement mechanism also cooperates with the vacuum system 65 and cams 85 to unfold the blanks 5.

For those purposes, the carton advancement mechanism 11 comprises a pair of endless laterally spaced chains 89 trained around appropriate sprockets, such as an upstream sprocket 91. The chains 89 and sprockets 91 are driven from the main drive shaft 33 (FIG. 7) by conventional components, not illustrated in the drawings. The top runs 92 of the chains 89 travel in the downstream direction 9.

To the chains 89 are connected a plurality of pairs of upstanding flight bars 93. The longitudinal spacing between consecutive flight bars 93 along the chains 89 define pockets 94. The distance between consecutive flight bars is slightly greater than the length of the carton top and bottom panels 34 and 38, respectively. The upstream sprocket 91 is located and the carton advancement mechanism 11 is operated such that during a dwell period a pair of flight bars 93*a* are approximately aligned with the profiles 86 of the unfolding cams 85. At that location, the flight bars 93*a* are oriented at an upstream angle relative to the carton path 8. Both the flight bars 93*a* and the next consecutive downstream flight bars 93*b* are positioned to enable the vacuum system 65 to pull the partially unfolded blank 7*a* into the pocket 94*a*. When the partially unfolded blank is completely in the pocket 94*a*, the blank trailing edge 63*a* is engaged in the cam notches 89, and the blank leading edge 61*a* is adjacent the downstream flight bars 93*b*. Thus, the partially unfolded blank is captured in the pocket 94*a*.

At the end of the dwell period, the carton advancement system 11 is operated to advance the chain top run 92 in the downstream direction 9. The leading edges 95*a* of the flight bars 93*a* strike the blank trailing edge 63*a*. As the flight bars 93*a* round the upstream sprocket 91, they approach an upright attitude as shown in phantom lines 93*a* of FIG. 1. Simultaneously, the next consecutive downstream flight bars 93*b* also advance downstream. However, for clarity flight bar 93*b* shown as though it momentarily is stationary with respect to the machine frame 28. Rounding the sprocket 91 causes the flight bars 93*a* to push the blank trailing edge 63*a* in the downstream direction 9 such that the blank leading edge 61*a* abuts the trailing edges 97*b* of the next consecutive downstream flight bars 93*b* and ultimately to completely unfold the blank to the unfolded open side carton 7. A hook 99 on each flight bar positively restrains the carton in the pocket.

Continued operation of the carton advancement mechanism 11 causes the cartons 7 to be advanced in the downstream direction 9 away from the unloading station 3 and toward the flap tuckers 19.

Flap Tuckers

With particular attention to FIGS. 4 and 5, the flap tuckers 19 will be described. The flap tuckers positively control the location of the carton leading flaps 49 and trailing flaps 51 (FIG. 10). For that purpose, the flap tuckers comprise a pair of curved fingers 101 that are located above the machine support strips 81 and about midway between the top and bottom panels 34 and 38, respectively, of the carton 7. The fingers 101 oscillate in unison about respective vertical shafts 103 between two end positions. The first end position is shown in phantom lines 101*a* of FIG. 5. The second end position is shown in solid lines 101 of FIGS. 4 and 5. In both end positions, the fingers are in the paths of the carton leading and trailing flaps 49 and 51, respectively.

The flap tucker fingers 101 are in the first end positions 101*a* as the carton leading flaps 49 approach in the downstream direction 9 under the influence of the carton advancement mechanism 11. When a leading flap 49 is in the position shown in phantom line 49*a* of FIG. 5, the leading flap strikes the upstream side 105*a* of the finger. Continued downstream advancement of the carton causes the leading flap to bend slightly in the upstream direction, as shown by phantom line 49*b* of FIG. 5. Ultimately, the leading flap passes over the finger. The natural resiliency of the carton material causes the leading flap to return to approximately the position shown by phantom line 49*c*. The main drive shaft 33 of the side loading machine 1 operates through an appropriate take-of, not shown, so as to rotate the fingers in the direction of arrows 107 to their second end positions. Such rotation of the fingers bends the leading flaps about their respective fold lines 57 to a position 49*d* whereat they are generally parallel to the downstream direction 9. The fingers are designed to restrain the leading flaps parallel to the downstream direction as the carton continues to advance, such as to position 40*d*. In addition, stationary plows 109 and 110 positively control the carton top and bottom flaps 45 and 47, respectively, in known manner. The plows 109 fold the top flaps upwardly along their respective fold lines 53, and the plows 110 fold the bottom flaps downwardly about their respective fold lines 55. Also see FIG. 3.

Loading Station

The articles 17 fed by the conveyors 20 along the article paths 21 are loaded into the open side cartons 7 at the loading station 13 by the side loading mechanism 18. In the preferred embodiment, the side loading mechanism comprises chains 111, 111*a* on opposite sides of the carton path 8. Each of the chains 111 and 111*a* is trained over respective sprockets 113, 115, and 113*a*, 115*a*. The sprockets 113, 115 and 113*a*, 115*a* are connected to respective shafts 106, 108, and 106*a*, 108*a* that are rotatably mounted to the machine frame 28. The shafts 106, 108, and 106*a*, 108*a* and the sprockets are preferably arranged so as to form generally rectangular chain paths 116 and 116*a*. The chain paths 116 and 116*a* have respective vertical runs 112, 112*a* and horizontal runs 114 and 114*a*. Power for driving the side loading mechanism comes from the main drive shaft 33 through a chain 122 to a wrap clutch 121, as will be described in detail hereinafter. See FIGS. 7 and 8. The output shaft of the wrap clutch 121 is coupled to an indexing drive 124. The indexing drive 124 drives an input chain 119, which in turn drives the chains 111 of the chain path 116. The chains 111*a* of the path 116*a* are driven at the same speed and in the opposite direction as the chains in path 116 by an intermediate pair of chains and sprockets 118 and reversing gears 120.

Joined to the chains 111, 111*a* and extending parallel to the downstream direction 9 are a number of pusher bars 117. The side loading mechanism 18 is operated, as will be explained, such that a pusher bar 117*a* is at a stop position proximate both leading flaps 49 of a carton 7 as the carton is advanced to the loading station 13. The locations of the pusher bars 117*a* at their respective stop positions is such that the carton leading flaps 49 are tucked behind and restrained parallel to the downstream direction 9 by those pusher bars as the carton advances past and the leading flaps break contact with the flap tucker fingers 101. With some cartons, the lengths of the leading and trailing flaps 49 and 51, respectively, may be such that the leading flaps of a carton overlap the respective trailing flaps of the next consecutive downstream carton 7*e*, FIG. 5.

The carton advancement mechanism 11 advances the carton 7 until is lies between the two pusher bars 117*a* at their respective stop positions on either side of the carton path 8. Such advancement causes the carton trailing flaps 51 to strike the back sides 105 of the respective flap tucker fingers 101, which remain in their respective second end positions after having bent the leading flaps in the downstream direction. Consequently, the trailing flaps attain the attitude shown at reference numerals 51*e* in FIG. 4 when the carton is between the two opposed pusher bars 117*a*. At that point, the carton advancement mechanism halts for a dwell period. The carton leading flaps 49 maintain the general attitude shown at reference numeral 49*e*.

Meanwhile, the articles 17 are fed intermittently in unison with the operation of the carton advancement mechanism 11 along the article paths 21 by the infeed conveyors 20 to reach article waiting stations 123. The article waiting stations 123 straddle the carton 7 at the loading station 13 and are in line with the pusher bar paths 116 and 116*a*. Stop plates 133 limit the downstream motion of the articles at their respective article waiting stations.

To guide the articles 17 in each path 21 into an article waiting station 123, one edge 128 of a complement 15 is guided by a pusher bar 117*b*. The pusher bar 117*b* is spaced from the pusher bar 117*a* at the stop position so as to be ready to index to the stop position of pusher bar 117*a* and thereby push the complement 15 at the article waiting station into the carton. The complements are guided on their opposite edges 130 by a split platform 125. Each split platform 125 has a stationary plate 127 adjacent the carton path 8 and a moveable plate 129 adjacent the article conveyor 20. The moveable plate 129 is selectively raised and lowered by means of a linear actuator, such as an air cylinder 131. When the articles 17 are fed by the conveyors 20 to the respective waiting stations 123, the air cylinders 131 are actuated to raise the moveable plates 129 to the positions shown by phantom lines 129*a* of FIG. 3. Consequently, the articles in each path 21 are guided along their opposed edges 128 and 130 by the pusher bar 117*b* at the ready position and the raised plate 129*a*, respectively.

Figure 3:
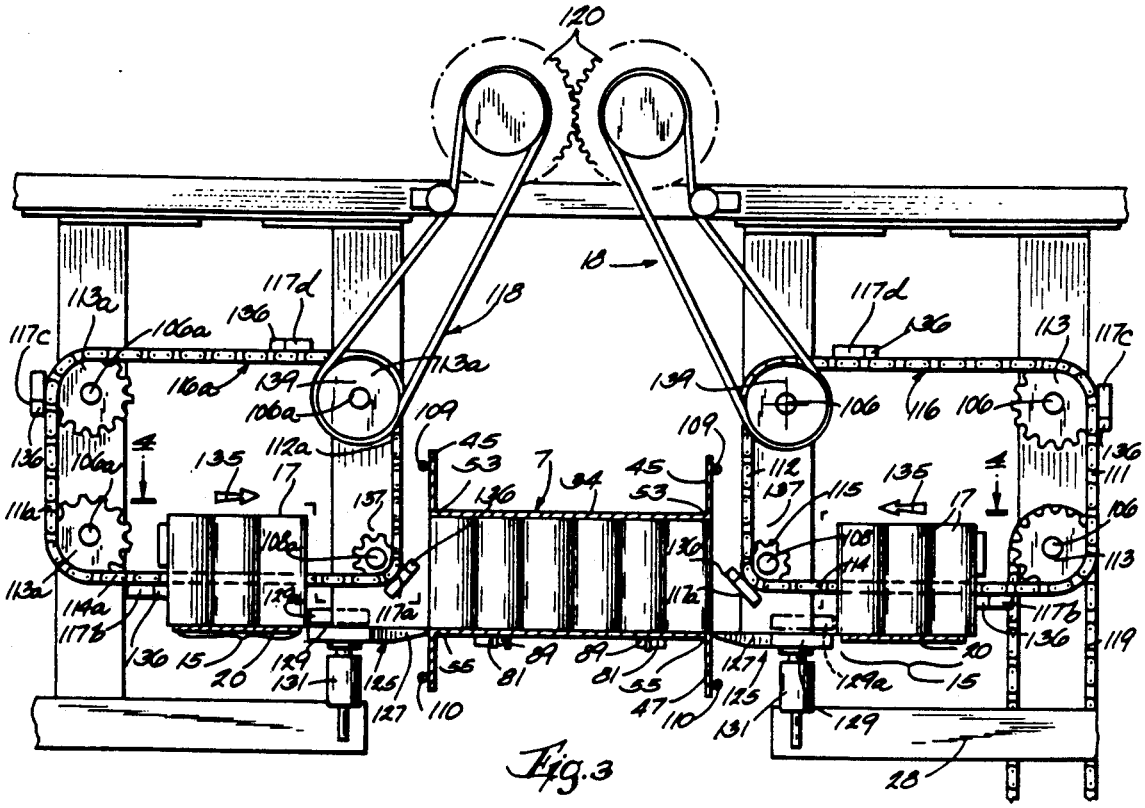
FIG. 3 is an end view, partially in section, of the loading station of the present invention.

After the articles 17 are in place at the article waiting stations 123, the air cylinders 131 actuate the moveable plates to lowered positions generally coplanar with the fixed plates 127, as is shown by the solid lines 129 of FIG. 3. To load the complements of articles 17 at the article waiting stations into the carton 7, the wrap clutch 121 (FIG. 7) is actuated to drive input chain 119. In turn, the input chain drives the chains 111 and 111*a* in the two paths 116 and 116*a*, respectively, in the directions of arrows 135. As a result, the pusher bars 117*b* at their respective ready positions push the complements at the waiting stations along the horizontal path runs 114 and 114*a* into the opposite sides of the carton. The pushing of the complements as controlled by the indexing clutch ceases when the pusher bars 117*b* attain their respective stop positions 117*a* adjacent the carton open sides. Pusher bars 117*c*, of course, are simultaneously indexed to the ready positions 117*b*.

Figure 13:
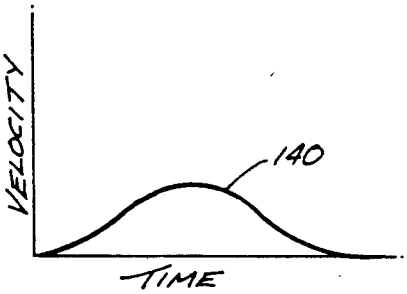
FIG. 13 is a typical velocity-time curve of the pusher bars during an indexing cycle.

To cushion the impact of the pusher bars 117*b* on the articles 17 during the loading process, the indexing drive 124 imparts smooth acceleration and deceleration to the input chain 119 and thus, to the chains 111 and 111*a*. A typical velocity-time curve 140 is depicted in FIG. 13. As a result, damage to the articles and shock loading on the side loading mechanism 18 is minimized. To further protect the articles as they are guided to the article waiting stations 123 by the pusher bars 117*b* at the ready positions and as the articles are pushed into the carton 7, the leading edge 136 of each pusher bar is preferably fabricated with a strip of tough and relatively soft but non-abrasive material, such as a synthetic plastic.

As soon as the side loading mechanism 18 has indexed to push two complements 15 into the carton 7, the dwell period ends and the carton advancement mechanism 11 operates to advance another carton to the loading station 13. Simultaneously, the next complements 15*a* are fed by the infeed conveyors 20 to the article waiting stations 123, where new pusher bars at the ready positions 117*b* are again ready to immediately push the complements into the carton during the next dwell period of the carton advancement mechanism. In that manner, very high loading rates are possible. That is due in large part to the fact that the pusher bars at the stop positions 117*a* are not withdrawn back to their ready positions at 117*b*, but rather the pusher bars previously at locations 117*c* advance directly to the ready positions. Therefore, there is no need to delay advancement of the cartons while waiting for the pusher bars to arrive at their ready positions.

It will be noticed from FIG. 3 that the sprockets 115, 115*a* in the paths 116, 116*a* have smaller diameters than the other sprockets 113, 113*a*. Further, the vertical centerlines 137 of the associated shafts 108, 108*a* are closer to the carton path 8 than the vertical centerlines 139 of the overhead shafts 106, 106*a*. The purpose of the relative sizes and locations of the sprockets 115, 115*a* and shafts 108, 108*a* relative to the sprockets 113, 113*a* and shafts 106, 106*a* is to enable the pusher bars at the stop positions 117*a* to begin their vertical runs 112, 112*a* as soon as possible after rounding the respective sprockets 115, 115*a*. In that manner, a pusher bar leaving the stop position 117*a* and indexing to position 117*d* does not strike the top panel 34 of the carton 7, which could occur if the sprockets 115, 115*a* have the relatively large diameters of the sprockets 113, 113*a*.

Flap Closing Station

With the complements 15 loaded into the carton 7, the carton advancement mechanism 11 is actuated to advance the filled carton 23 in the downstream direction 9 from the loading station 13 and to present the adjacent upstream carton to the loading station. The filled carton 23 advances to the flap closing station 25, FIGS. 4 and 6. It will be noticed that the leading flaps 49 of the carton at the loading station, which were controlled by the flap tucker fingers 101 and the pusher bars 117*a* to the open position 49*d* (FIG. 5) as the carton advanced to the loading station, have passed the downstream ends of the pusher bars 117*a* when the carton is stopped at the loading station. The natural resiliency of the carton material causes the leading flaps to return at least partially to their unfolded attitudes, such as is indicated by reference numerals 49*e* of FIGS. 4 and 6.

To close the leading and trailing flaps 49 and 51, respectively, the flap closing station 25 includes a pair of paddles 143. The paddles 143 oscillate about respective vertical axes 144. Paddle oscillation is in timed relation to the actuation of the carton advancement mechanism 11. When the carton advancement mechanism is stopped to load a carton 7 at the loading station 13, the paddles 143 are in a first end position indicated by the solid lines 143 of FIGS. 4 and 6. The paddles remain in their respective first end positions while the carton advancement mechanism advances the filled carton 23 from the loading station to the flap closing station; a filled carton at a flap closing station is indicated by reference numeral 23*f*. As the filled carton is advanced from the loading station to the flap closing station, the leading flaps 49 strike the paddle upstream ends 145. The leading flaps are thus bent to a closed position, as is indicated by reference numeral 49*f* in FIG. 6. Plows 141 retain the leading flaps in their closed positions after the filled carton has advanced downstream of the paddles. The plows 141 may also serve to close the top and bottom flaps, 45 and 47, respectively.

Figure 4:
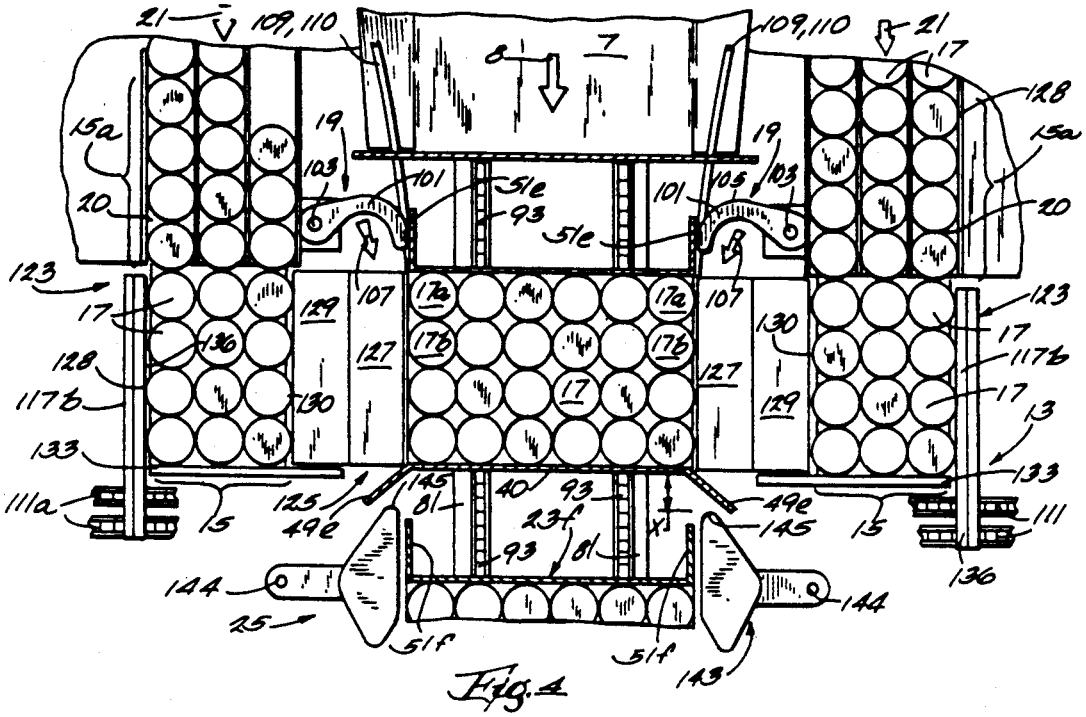
FIG. 4 is a cross-sectional view taken along lines 4—4 of FIG. 3.
Figure 6:
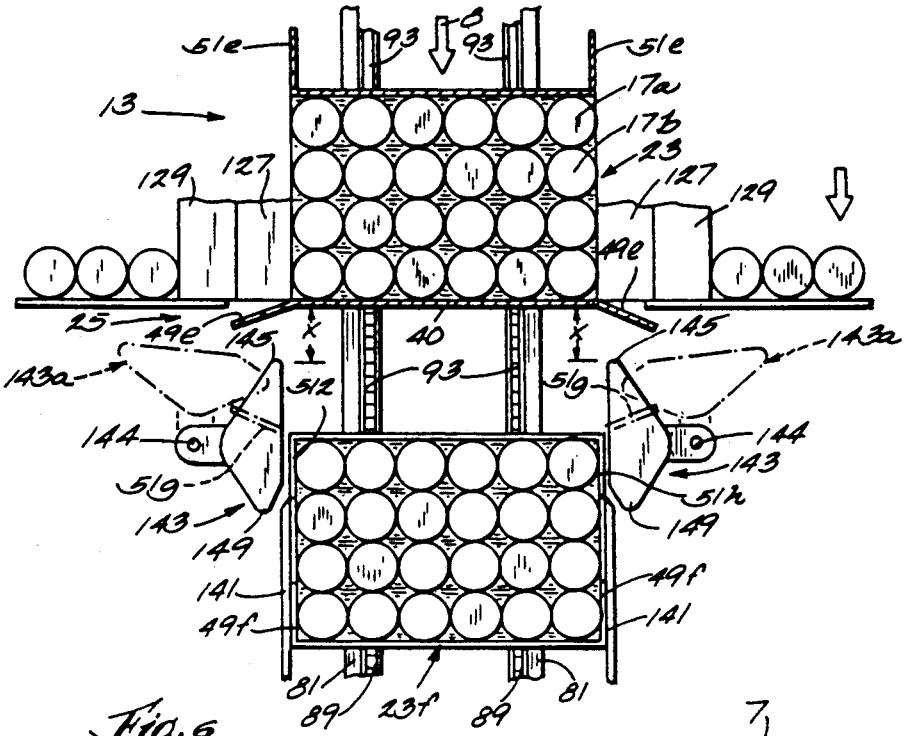
FIG. 6 is a top view of the flap closure station of the present invention.
Figure 5:
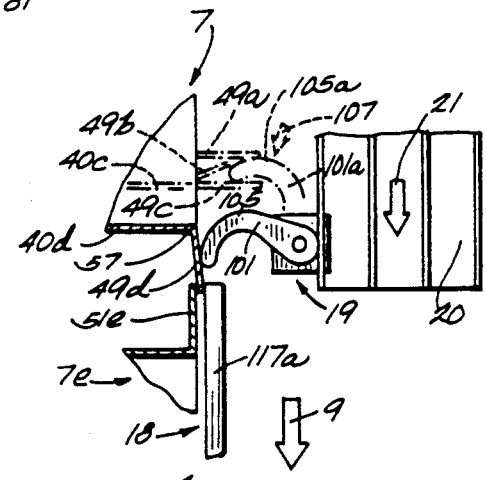
FIG. 5 is a top view of a flap tucker according to the present invention.

After the filled carton 23 has been advanced past the loading station 13, the trailing flaps, which had been controlled by the flap tucker finger 101 and the pusher bar 117*a* to the open position 51*e* of FIGS. 4 and 6, pass the downstream ends of the pusher bars 117*a*. The carton trailing flaps strike the upstream ends 145 of the respective paddles 143, such that the trailing flaps maintain fully opened positions, as is illustrated by reference numeral 51*f* of FIG. 4.

While the carton advancement mechanism 11 is in a dwell period, the paddles 143 rotate to their respective second end positions shown by the phantom lines 143*a* of FIG. 6. Paddle rotation is such that the paddle downstream ends 149 completely clear the trailing flaps. As a consequence, the carton trailing flaps 51 are released. The natural resiliency of the carton material causes the trailing flaps to return to an attitude between the fully opened and closed positions, such as is indicated by the phantom lines 51*g* of FIG. 6. At that point, the paddles reverse direction and return to their respective first end positions as shown by the solid lines 143 of FIGS. 4 and 6. As they so rotate, their downstream ends 149 strike the respective trailing flaps that are in the position of phantom lines 51*g* and fully close the trailing flaps to their respective positions shown by the solid lines 51*h* of FIG. 6. At that point, all the carton flaps are closed. The plows 141 maintain the closed position of all of the flaps as the filled carton 23*f* is again advanced by the carton advancement mechanism 11 to a gluing station further downstream. At the gluing station, the flaps are glued in place by apparatus known in the art.

It will be noticed that a gap X exists between the upstream ends 145 of the paddles 143 and the leading panel 40 of the carton 7 at the loading station 13 when the paddles are in their respective first positions. The paddles are designed such that their upstream ends 145 are as close to the loading station as possible when the paddles are in their first positions, thereby minimizing the gap X. Having a minimum gap is important for reducing the possibility that an article, such as article 17*a* or 17*b*, might fall out of the filled carton open side as the carton is advanced from the loading station to the flap closing station 25. Once the carton reaches the flap closing station, the possibility of an article falling out is eliminated.

Tray Loading

Figure 11:
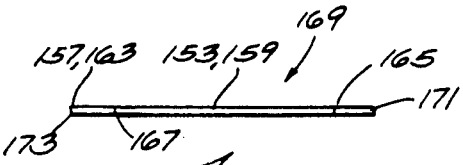
FIG. 11 is a side view of an unfolded tray that is advantageously loaded by the side loading machine of the present invention.
Figure 12:
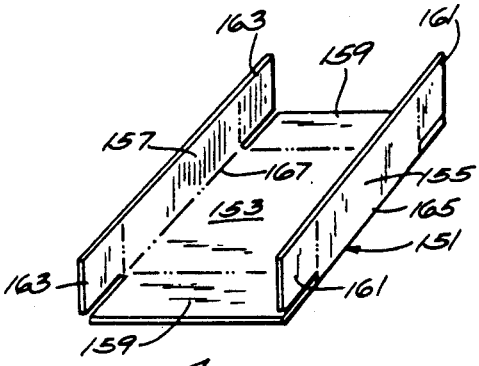
FIG. 12 is a perspective view of the tray of FIG. 11 shown in a fully folded configuration.

Further in accordance with the present invention, the side loading machine 1 is capable of side loading open side trays as well as four sided cartons 7. Turning to FIGS. 11 and 12, a tray 151 is depicted that can be side loaded in generally the same manner as the open side cartons previously described. The tray 151 has a bottom panel 153, a leading panel 155, and a trailing panel 157. The tray further has bottom flaps 159 that extend oppositely from the bottom panel 153, leading flaps 161 that extend from the leading panel 155, and trailing flaps 163 that extend from the trailing panel 157. The bottom panel is separated from the leading and trailing panels by fold lines 165 and 167, respectively.

Figure 14:
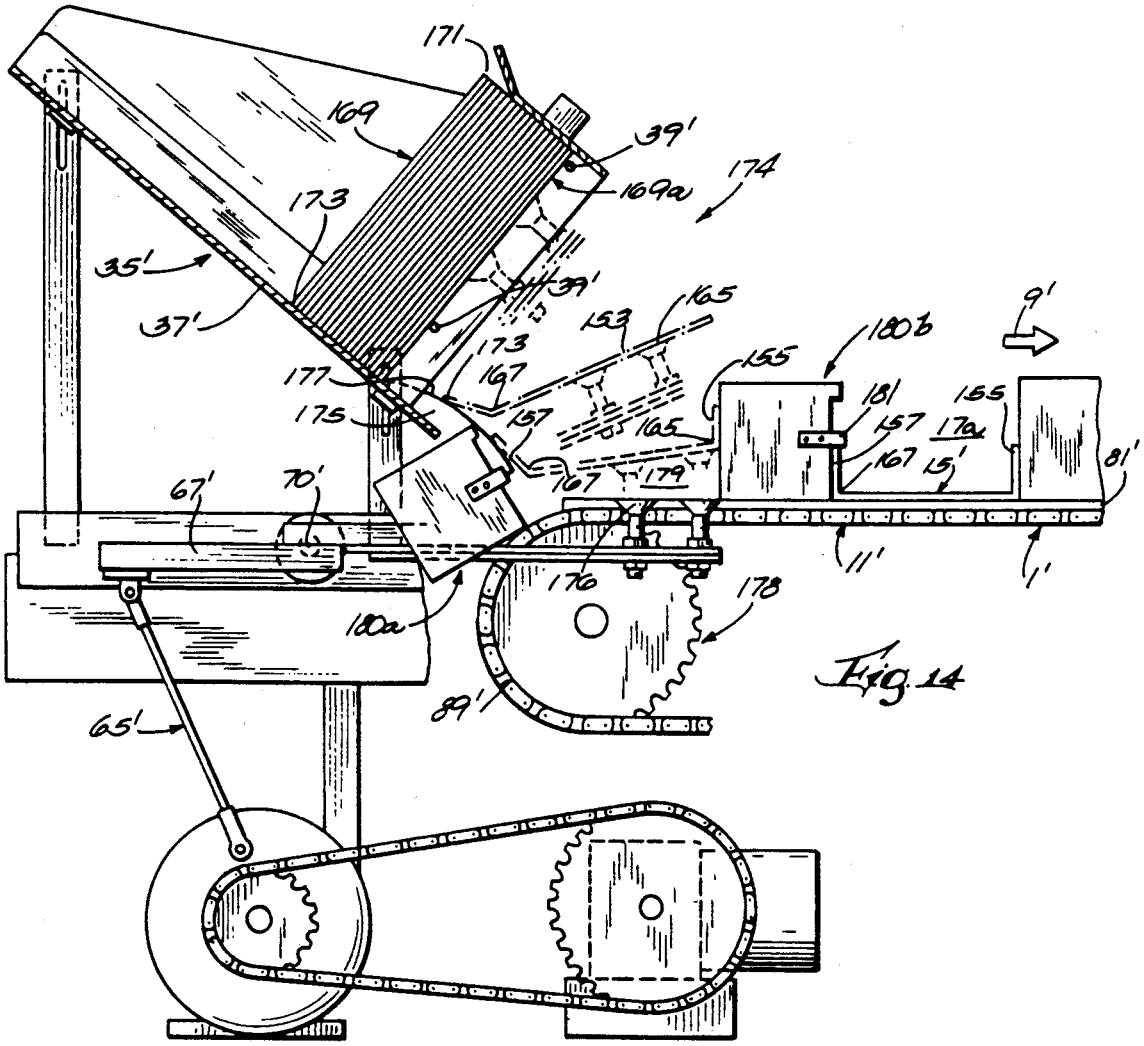
FIG. 14 is a side view of a loading station for supplying open side trays to the side loading machine of the present invention.

Looking also at FIG. 14, the trays 151 are supplied to the side loading machine 1' in the form of flat blanks 169. In the flat condition, the blanks 169 have respective leading edges 171 and trailing edges 173. The loading station 174 of the machine 1' includes a hopper 35' and vacuum system 65' similar to the hopper 35 and vacuum system 65 described in connection with FIGS. 1 and 2. The blanks 169 are supported in the hopper 35' by the back wall 37' and pins 39'. The vacuum system 65' includes a lever 67' with suction cups 176. The lever 67' oscillates about axis 70' in synchronization with the intermittent motion of a tray advancement mechanism 178. The suction cups 176 grip the lowermost blank 169*a* in the hopper 35' and pull it toward a pocket 179 between consecutive flight bars 180*a* and 180*b*, which are connected to a pair of laterally spaced chains 89' of the tray advancement mechanism 178.

As the suction cups 176 pull the lowermost blank 169*a* from the hopper 35', the blank trailing edge 173 strikes and rides along a cam 175. The cam 175 has a very shallow profile 177. As the blank trailing edge 173 rides along the cam profile 177, the trailing flap 157 is bent along fold line 167. Continued rotation of the lever 67' causes the blank leading panel 155 to strike the downstream flight bar 180*b* of the pocket 179. Additional pulling of the blank bottom panel 153 by the suction cups 176 causes the blank leading panel 155 to bend along the fold line 165. Finally, the suction cups 176 pull the partially unfolded tray completely into the pocket 179 and against a pair of horizontal longitudinally extending support strips 81'. The spacing between the flight bars 180*a* and 180*b* is such that the completely unfolded tray 151 is captured between them. Bars 181 are slidable and lockable on the respective flight bars at a proper location above the support strips 81' to suit the heights of the tray leading and trailing panels 155 and 157, respectively. At the end of the dwell period, the tray advancement mechanism 178 advances the tray 151 from the loading station 174 in the downstream direction 9' in the same manner as was described previously in connection with the cartons 7. Control of the tray flaps 159, 161, and 163 and side loading of the trays is also substantially identical to that described previously in connection with the cartons 7.

Thus, it is apparent that there has been provided, in accordance with the invention, a side loading machine that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as follows in the spirit and broad scope of the appended claims.

I claim:

1. A side loading machine for loading complements of articles into an open side carton comprising:

a. means for supplying carton blanks having respective leading and trailing edges and oppositely extending leading and trailing flaps and for partially unfolding the blanks;

b. carton advancement means for completely unfolding and intermittently advancing the unfolded cartons horizontally along a carton path in a downstream direction;

c. flap tucker means for positively controlling the leading and trailing flaps of the unfolded open side carton;

d. conveyor means for feeding the articles along article paths in the downstream direction parallel to and on opposite sides of the carton path;

e. side loading means downstream from the flap tucker means for indexing unidirectionally along closed paths in timed relation with the carton advancement means and the conveyor means to push complements of articles from the article paths into the open side carton from the opposite sides thereof to thereby fill the cartons; and f. flap closing means downstream from the side loading means for positively closing the leading and trailing flaps of the filled cartons.

2. The side loading machine of claim 1 wherein the means for supplying carton blanks and for partially unfolding the blanks into open side cartons comprises:

a. hopper means located generally above the carton advancement mechanism for storing a supply of blanks;

b. vacuum means for pulling a selected blank from the supply thereof to the carton advancement mechanism;

c. at least one cam attached to the hopper means, the cam being in the path of the trailing edge of the blank being pulled from the hopper means to the carton advancement means, so that the blank trailing edge strikes the cam and the cam and vacuum means cooperate to partially unfold the blank as it is pulled by the vacuum means to the carton advancement mechanism.

3. The side loading machine of claim 2 wherein:

a. the carton advancement means comprises a plurality of pockets for receiving respective partially unfolded blanks; and b. the cam is formed with a notch that receives the trailing edge of the partially unfolded blank when the blank has been pulled into a selected pocket by the vacuum means, the cam notch cooperating with the carton advancement means to capture the partially unfolded blank within the selected pocket.

4. The side loading machine of claim 1 wherein the flap tucker means comprises finger means adjacent the carton path for oscillating in timed relation to the advancement of the carton advancement means to positively control the carton leading and trailing flaps.

5. The side loading machine of claim 4 wherein the finger means comprises a pair of curved fingers that oscillate about respective vertical axes on both sides of the carton path, the fingers oscillating from perspective second end positions to respective first end positions to strike the carton leading flaps and bend them into a direction parallel to the carton path to thereby positively control the carton leading flaps, the fingers subsequently returning to their respective first end positions to positively control the carton trailing flaps as the carton advancement means advances the carton in the downstream direction.

6. The side loading machine of claim 5 wherein:

a. the fingers have respective upstream surfaces; and b. the carton trailing flaps strike the finger upstream surfaces as the carton is advanced downstream past the fingers to bend the carton trailing flaps into a direction generally parallel to the carton path and thereby positively control the carton trailing flaps.

7. The side loading machine of claim 1 wherein the side loading means comprises first and second pusher bar means for indexing in respective closed paths that are generally coplanar and perpendicular to the carton path, the pusher bar means in the first path traveling in the opposite direction as the pusher bar means in the second path, the first and second pusher bar paths having respective first horizontal runs extending between the respective article paths and the carton path, the first and second pusher bar means being indexed to simultaneously push the articles from the respective article paths along the respective first horizontal runs into both sides of the open side carton.

8. The side loading machine of claim 1 wherein the side loading means comprises first and second pusher bar means for indexing in opposite directions and in closed generally coplanar paths located on opposite sides of the carton path and generally perpendicular thereto to push articles from the respective article paths into opposite sides of the open side carton.

9. The side loading machine of claim 8 wherein each of the first and second pusher bar means comprises a plurality of pusher bars that index along a horizontal run to push articles from the article path into the open side carton and subsequently along a vertical run adjacent the filled carton, the vertical run being defined by a first sprocket having a first diameter at the intersection of the horizontal and vertical runs and by a second sprocket generally above the first sprocket and having a second diameter greater than the first diameter to thereby enable a pusher bar to round the first sprocket after pushing the articles into the carton and to begin the vertical run without striking the carton.

10. The side loading machine of claim 8 wherein the side loading means further comprises guide means for guiding the articles along the respective article paths into positions whereat the articles can be pushed by the first and second pusher bar means into the open side carton.

11. The side loading machine of claim 10 wherein the guide means comprises:

a. a split platform extending between each article path and the carton path and having first and second plates, the first plate being vertically reciprocable between a lowered position whereat it is coplanar with the second plate and a raised position whereat it is located vertically higher than the second plate, the articles being guided along the article path by the first plate when it is in the raised position; and b. actuator means for reciprocating the first plate in synchronization with the indexing of the pusher bar means to raise the first plate when the pusher bar means is in a dwell period and to lower the first plate when the pusher bar means is indexed to push the articles into the open side carton.

12. The side loading machine of claim 11 wherein:

a. each of the first and second pusher bar means comprises a plurality of pusher bars that index in the respective closed paths; and b. a selected pusher bar cooperates with the associated split platform to guide the articles along the article path into a position whereat the selected pusher bar can push the articles from the article path to the open side carton.

13. The side loading machine of claim 1 wherein the flap closing means comprises paddle means adjacent the carton path for oscillating in timed relation to the carton advancement means to positively control the carton leading and trailing flaps.

14. The side loading machine of claim 13 wherein the paddle means comprises a pair of paddles that oscillate about respective vertical axes on both sides of the carton path, each paddle oscillating between first and second end positions, the paddles positively controlling the carton leading flaps when the paddles are in their respective first positions, the paddles oscillating between their respective first and second positions to positively control the carton trailing flaps.

15. The side loading mechanism of claim 13 wherein:

a. the paddle means comprises at least one paddle having an upstream end and a downstream end, the paddle oscillating between first and second positions;

b. the paddle is in the first position thereof and the carton leading flap strikes the paddle upstream end as the carton is advanced in the downstream direction by the carton advancement means past the paddle to bend the carton leading flap to a closed position generally parallel to the carton path; and c. the paddle rotates from the first position in the second position and subsequently from the second position thereof to the first position to bend the carton trailing flap to the closed position as the carton is advanced in a downstream direction past the paddle.

16. Apparatus for side loading open side cartons having end flaps comprising:

a. a horizontal longitudinally extending frame;

b. means mounted to the frame for supplying folded carton blanks and for partially unfolding the blanks at an unfolding station;

c. carton advancement means for receiving the partially unfolded blanks and for completely unfolding the blanks into open side cartons and for operating intermittently to advance the cartons in a downstream direction from the unfolding station along a horizontal carton path to a loading station;

d. flap tucker means downstream from the unfolding station for positively controlling the carton leading and trailing flaps;

e. conveyor means for feeding articles along article paths on both sides of the carton path to article waiting stations;

f. side loading means supported by the frame at the loading station for unidirectionally indexing in closed paths in timed relation with the carton advancement means to push articles from the article waiting stations into the open side carton; and g. flap closing means downstream from the loading station for positively controlling the leading and trailing flaps of the filled cartons.

17. The apparatus of claim 16 wherein the means for supplying folded carton blanks and for partially unfolding the blanks comprises a. hopper means fixed to the frame and generally thereabove for storing a supply of blanks;

b. pulling means for pulling a selected blank from the hopper means to the carton advancement means during a dwell period of the intermittent operation of the carton advancement means; and c. cam means attached to the hopper means and in the path of a portion of the blank being pulled from the hopper means for cooperating with the pulling means to partially unfold the blank prior to the blank being received by the carton advancement means.

18. The apparatus of claim 17 wherein the cam means defines notch means for engaging a portion of the partially unfolded blank and for cooperating with the carton advancement means to capture the partially unfolded blank in a controlled position within the carton advancement means.

19. The apparatus of claim 17 wherein:

a. each blank has bottom, leading, and trailing panels;

b. the carton advancement means comprises a plurality of flight bars spaced in the downstream direction to form pockets between consecutively spaced flight bars, each pocket being defined by an upstream flight bar and a downstream flight bar;

c. the pulling means pulls the bottom panel of the selected blank toward a selected pocket of the carton advancement means;

d. the cam means is in the path of the trailing panel of the selected blank to thereby unfold the carton trailing panel relative to the bottom panel; and e. the downstream flight bar of the selected pocket is in the path of the leading panel of the selected blank to thereby unfold the carton leading panel relative to the bottom panel, so that the carton is substantially unfolded when it is received in the selected pocket.

20. The apparatus of claim 16 wherein the flap tucker means comprises a plurality of fingers mounted to the frame for oscillation about respective vertical axes on both sides of the carton path, the fingers oscillating in timed relation with the carton advancement means to positively control the carton trailing and leading flaps.

21. The apparatus of claim 16 wherein the flap tucker means comprises a pair of fingers rotatingly mounted to the frame on opposite sides of the carton path for oscillating about respective vertical axes between first and second end positions, the fingers oscillating from the second position to the first position to positively control the carton leading flaps as the carton advancement means advances the cartons in the downstream direction, the fingers remaining stationary in their respective first positions to positively control the carton trailing flaps.

22. The apparatus of claim 16 wherein the side loading means comprises:

a. chain and sprocket means for defining a closed path on each side of the carton path, the closed paths lying in planes perpendicular to the carton path;

b. a plurality of horizontal pusher bars joined to the chain and sprocket means of each closed path; and c. drive means for indexing the chain and sprocket means to push articles with the pusher bars from the respective article waiting stations into an open side carton.

23. The apparatus of claim 22 wherein each of the chain and sprocket means closed paths comprises a horizontal run extending from an article waiting station to the carton path, and a vertical run extending vertically upwardly from the horizontal run and adjacent the carton path.

24. The apparatus of claim 23 wherein each chain and sprocket means comprises a first sprocket at the junction of the horizontal and vertical runs and having a diameter that enables the pusher bars joined to the chain and sprocket means to change direction from the horizontal to the vertical runs after the pusher bar has pushed the articles into the open side carton without striking the carton.

25. The apparatus of claim 22 wherein:

a. the side loading means further comprises platform means associated with each closed path for selectively guiding the articles along the respective article path to the article writing station and for supporting the articles being pushed from the article waiting station to the open side carton; and b. a selected pusher bar cooperates with the associated platform means to guide the articles to the article waiting station

26. The apparatus of claim 25 wherein each platform means comprises:

a. a first plate fixed to the frame adjacent the carton path; and b. a second plate adjacent the article waiting station and reciprocable between a lowered position wherein it is coplanar with the first plate and a raised position higher than the first position, the second position being located to guide the articles along the article path to the article waiting station; and c. actuator means for selectively reciprocating the second plate between the lowered and raised positions, so that the second plate is selectively raised to guide articles to the article waiting station and lowered to enable the selected pusher bar to push the articles at the waiting station into the open side carton.

27. The apparatus of claim 16 wherein the flap closing means comprises a pair of paddles mounted to the frame on both sides of the carton path for oscillating about respective vertical axes in timed relation with the carton advancement means to close the leading and trailing flaps as the carton advancement means advances the filled cartons in the downstream direction.

28. The apparatus of claim 16 wherein the flap closing means comprises a pair of paddles mounted to the frame on opposite sides of the carton path for oscillating between first and second positions, the paddles being in their respective first positions to positively control the carton leading flaps, each paddle oscillating from the first position to the second position and subsequently from the second position thereof to the first position to positively control the carton trailing flaps.

29. The apparatus of claim 28 wherein:

a. each paddle has spaced apart upstream and downstream ends; and b. the paddle upstream end is proximate the loading station when the paddle is in the first position, so that the paddles prevent articles loaded into the open sided carton from falling out as the filled carton is advanced from the loading station to the flap closing means.

30. Apparatus for unfolding folded carton blanks comprising:

a. hopper means for storing a quantity of folded blanks;

b. flight bar means located generally under the hopper means for intermittently advancing in a downstream direction therefrom and for defining a plurality of pockets;

c. pulling means for pulling a selected blank from the hopper means into a selected pocket; and d. cam means partially in the path of the selected blank for cooperating with the pulling means to partially unfold the selected blank as it is pulled into the selected pocket, wherein the cam means comprises notch means for engaging a portion of the partially unfolded blank pulled into the selected pocket and for cooperating with the flight bar means to capture the partially unfolded blank in the selected pocket.

31. A method of forming an open side tray having bottom, leading, and trailing panels comprising the steps of:

a. storing a supply of planar tray blanks;

b. providing a plurality of flight bars advanceable in a downstream direction generally under the supply of blanks, the flight bars being spaced apart to define pockets bounded by respective upstream and downstream flight bars;

c. pulling the bottom panel of a selected blank generally downwardly toward a selected pocket;

d. retarding the blank trailing panel during continued pulling of the blank bottom panel toward the selected pocket by providing at least one cam in the path of the blank trailing panel as it is pulled from the supply of blanks to the selected pocket; and striking the cam with the blank trailing panel as the blank bottom panel is pulled to the selected pocket;

f. pulling the blank bottom panel completely into the selected pocket; and g. advancing the flight bar to fully open the open side tray.

32. The method of claim 31 wherein the step of retarding the blank leading panel during pulling thereof comprises the step of striking the blank leading panel on the downstream flight bar of the selected pocket as the bottom panel is pulled into the selected pocket.

33. A method of loading articles into open side cartons having leading and trailing flaps comprising the steps of:

a. storing a supply of carton blanks;

b. unfolding a carton blank into an open side carton;

c. advancing the open side carton in a downstream direction along a carton path to a loading station;

d. feeding articles to be loaded in respective article paths on both sides of the carton path to article waiting stations;

e. providing a plurality of pusher bars that index in closed paths on both sides of the carton path and in a plane perpendicular thereto;

f. indexing the pusher bars to push respective complements of articles from the article waiting stations into the open side carton; and g. advancing the filled carton downstream from the loading station.

34. The method of claim 33 wherein the step of unfolding a carton blank comprises the steps of:

a. providing a plurality of flight bars that are spaced in a downstream direction, the flight bars defining consecutively spaced pockets;

b. pulling a selected blank from the supply thereof into a selected pocket; and c. striking a cam with a portion of the blank being pulled into the selected pocket to thereby partially unfold the blank as it is pulled into the selected pocket.

35. The method of claim 33 comprising the further steps of:

a. providing a finger on both sides of the carton path upstream of the loading station;

b. oscillating the fingers about respective axes in timed relation to the advancement of the open side cartons in the downstream direction from a second position to a first position to positively control the leading flaps of the open side cartons; and c. holding the fingers at their respective first positions to positively control the trailing flaps of the open side carton.

36. The method of claim 33 wherein the step of feeding articles to the article waiting station comprises the steps of:

a. providing a split platform between the article waiting station and the carton path;

b. operating at least a portion of the split platform to a raised position; and c. guiding the articles to the article waiting station between the raised split platform and a selected pusher bar at the article waiting station.

37. The method of claim 36 wherein the step of indexing the pusher bars comprises the steps of:

a. operating the split platform to a lowered position; and b. pushing the articles to be loaded over the lowered split platform from the article waiting station to the open side carton.

38. The method of claim 33 wherein the step of indexing the pusher bars comprises the steps:

a. indexing first pusher bars in a horizontal direction to push the respective complements of articles from the article waiting stations to the open side carton; and b. simultaneously indexing second pusher bars in generally vertical directions and proximate the open side carton, the second pusher bars avoiding contact with the open side carton.

39. The method of claim 33 comprising the further steps of:

a. providing a paddle on each side of the carton path downstream of the loading station;

b. positioning the paddles to respective first end positions in the paths of the leading flaps of the filled carton to thereby positively control the leading flaps; and c. oscillating the paddles about respective axes in timed relation with the advancement of the filled carton from the first positions to the second positions and subsequently from the respective second positions to first positions to positively control the carton trailing flaps.

40. A method of unfolding a carton blank into an open side carton comprising the steps of:

a. storing a supply of blanks having respective leading and trailing edges and bottom and trailing panels;

b. providing a plurality of flight bars advanceable in a downstream direction generally under the supply of blanks, the flight bars being spaced apart to define pockets bounded by respective upstream and downstream flight bars;

c. pulling the bottom panel of a selected blank generally downward toward a selected pocket;

d. retarding the blank trailing panel during continued pulling of the blank bottom panel to thereby partially unfold the blank by locating at least one cam into the path of the blank trailing panel as it is pulled from the supply of blanks to the selected pocket; and striking the cam with the blank trailing panel as the blank bottom panel is pulled to the selected pocket;

e. capturing the partially unfolded blank in the selected pocket; and f. advancing the flight bars in the downstream direction to fully unfold the carton.

41. The method of claim 40 wherein the step of capturing the partially unfolded blank in the selected pocket comprises the step of:

a. providing a notch on the cam;

b. engaging the cam notch with the trailing edge of the partially unfolded blank; and c. contacting the downstream flight bar of the selected pocket with the partially unfolded blank leading edge to thereby capture the partially unfolded blank trailing and leading edges within the selected pocket.

42. Apparatus for forming open side trays from a blank comprising:

a. hopper means for storing a quantity of blanks having respective bottom, leading, and trailing panels;

b. a plurality of flight bars located generally under the hopper means and intermittently advancing therefrom in a downstream direction, the flight bars defining consecutively spaced pockets, each pocket being bounded by an upstream and a downstream flight bar;

c. pulling means for pulling the bottom panel of a selected blank from the hopper means to a selected pocket, the downstream flight bar of the selected pocket being in the path of the blank leading panel, the downstream flight bar of the selected pocket cooperating with the pulling means to bend the blank leading panel relative to the blank bottom panel; and d. cam means in the path of the blank trailing panel for cooperating with the pulling means to bend the blank trailing panel relative to the blank bottom panel, wherein the cam means comprises notch means for engaging a portion of the trailing edge panel pulled into the selected pocket and for cooperating with the flight bar to capture the partially unfolded blank in the selected pocket, so that the blank is formed into a tray as the blank is pulled from the hopper means into the selected pocket.

* * * * *

UNITED STATES PATENT AND TRADEMARK OFFICE

CERTIFICATE OF CORRECTION

PATENT NO. : 5,027,586

DATED : July 2, 1991

INVENTOR(S) : Dennis Ramaker

It is certified that error appears in the above—identified patent and that said Letters Patent is hereby corrected as shown below:

Column 16, line 59:
Delete "writing" and substitute --- waiting ---.

Column 18, line 4:
After "panel" insert --- to thereby partially unfold the blank; ---.

Column 18, Line 4:
After the above insertion indent and insert
--- e. retarding the blank leading panel during continued pulling of the blank bottom panel --- and continue
with "toward the selected pocket . . ."

Signed and Sealed this

Eighth Day of December, 1992

*Attest:*

DOUGLAS B. COMER

*Attesting Officer*

*Acting Commissioner of Patents and Trademarks*